US007096614B1

(12) United States Patent
Williams

(10) Patent No.: US 7,096,614 B1
(45) Date of Patent: Aug. 29, 2006

(54) MILITARY RIBBON ASSEMBLY

(76) Inventor: Daniel T. Williams, 124 Hidden Cave, Cibolo, TX (US) 78108

( * ) Notice: Subject to any disclaimer, the term of this patent is extended or adjusted under 35 U.S.C. 154(b) by 0 days.

(21) Appl. No.: 11/118,907

(22) Filed: Apr. 29, 2005

Related U.S. Application Data

(60) Provisional application No. 60/566,691, filed on Apr. 30, 2004.

(51) Int. Cl.
*A44C 3/00* (2006.01)

(52) U.S. Cl. ..... 40/1.5; 40/622; 24/303; 63/900

(58) Field of Classification Search ..... 40/622, 40/1.5; 24/114.05, 13, 3.1, 303, 66.1; 63/1.16, 63/40, 900
See application file for complete search history.

(56) References Cited

U.S. PATENT DOCUMENTS

| | | | | | |
|---|---|---|---|---|---|
| 1,235,580 | A | * | 8/1917 | McDougall | 40/1.5 |
| 2,392,351 | A | * | 1/1946 | Wolf | 40/1.5 |
| 2,396,160 | A | * | 3/1946 | Coulter et al. | 40/1.5 |
| 2,413,056 | A | * | 12/1946 | Levyn | 40/1.5 |
| 2,464,395 | A | * | 3/1949 | Hilborn | 40/1.5 |
| 2,625,757 | A | * | 1/1953 | Wolf | 40/1.5 |
| 2,707,344 | A | * | 5/1955 | Bolognese | 40/1.5 |
| 2,730,824 | A | * | 1/1956 | Cohen | 40/1.5 |
| 2,795,876 | A | * | 6/1957 | Hayes | 40/1.5 |
| 2,821,787 | A | * | 2/1958 | Shepard | 33/653 |
| 2,832,161 | A | * | 4/1958 | Murphy | 40/1.5 |
| 2,834,129 | A | * | 5/1958 | Kirkbride | 40/1.5 |
| 2,847,773 | A | * | 8/1958 | Herrick | 40/1.5 |
| 3,192,655 | A | * | 7/1965 | Harn | 40/1.5 |
| 3,455,042 | A | * | 7/1969 | Carr et al. | 40/1.5 |
| 3,579,881 | A | * | 5/1971 | Cherry | 40/1.5 |
| 3,942,273 | A | * | 3/1976 | Adams | 40/1.5 |
| 4,137,657 | A | * | 2/1979 | Wardle | 40/1.5 |
| 5,123,188 | A | * | 6/1992 | Loda | 40/1.5 |
| 5,555,660 | A | * | 9/1996 | Whitehouse et al. | 40/622 |
| 6,122,805 | A | * | 9/2000 | Haegley | 24/114.4 |

* cited by examiner

*Primary Examiner*—Gary C. Hoge
(74) *Attorney, Agent, or Firm*—Kenneth L Tolar

(57) ABSTRACT

A military flat ribbon assembly includes a plurality of discrete military ribbons each including a base panel having a rear surface with one or more pegs extending therefrom. The assembly also includes a blank sheet having a rear surface and front surface with a plurality of apertures positioned thereon. The apertures are dimensioned and positioned so as to receive the pegs on the ribbon base panel. As military ribbons are earned, a user can attach them to a blank and cut any excess portion thereof. Pins on the rear surface of the blank allow it to be quickly and easily fastened to a military uniform. As additional ribbons are earned, the existing ribbons along with the new ribbons are attached to a new blank which is cut and attached to the uniform as described above. The pegs and blank sheet can be magnetized.

1 Claim, 2 Drawing Sheets

MILITARY RIBBON ASSEMBLY

CROSS REFERENCE TO RELATED APPLICATIONS

This application is entitled to the benefit of provisional application No. 60/566,691 filed on Apr. 30, 2004.

BACKGROUND OF THE INVENTION

The present invention relates to an assembly for conveniently attaching a plurality of ribbons to a military uniform.

DESCRIPTION OF THE PRIOR ART

As military ribbons are earned, they are typically attached to a military uniform. Military "flat" ribbons are typically glued to a base panel that in turn is fastened to the uniform with pins or similar fasteners. However, each time an additional ribbon is earned, a user must replace the existing flat ribbon set with one that includes all of the ribbons on a single panel. The present invention addresses this problem by providing a uniquely designed device that allows military flat ribbons to be easily attached, supplemented and/or replaced as such ribbons are earned.

SUMMARY OF THE INVENTION

The present invention relates to a military flat ribbon assembly. The device comprises a blank sheet formed of plastic or a similar material having a front surface and a rear surface. The sheet includes a plurality of holes each sized and positioned to receive pegs extending from any one of a plurality of accompanying ribbon base panels. The rear surface of the sheet includes a plurality of fastening pins thereon for fastening the sheet to the military uniform. An alternate version includes a ferrous blank to which magnetized base panels are secured.

Accordingly, as a particular ribbon is earned, its corresponding base panel is fastened to the blank by inserting the pegs into corresponding apertures. Any excess portion of the blank is cut and discarded. The remaining portion of the blank is then fastened to a military uniform using the fastening pins. As additional ribbons are earned, they along with the existing ribbons are secured to another blank which is fastened to the uniform as described above.

It is therefore an object of the present invention to provide a military flat ribbon assembly that allows a user to conveniently add additional flat ribbons to a military uniform.

It is another object of the present invention to provide a military flat ribbon assembly that is easy to use and inexpensive to manufacture.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
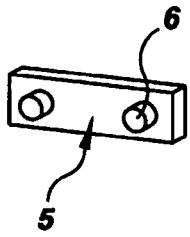
FIG. 1 is a perspective view of a ribbon base panel.
Figure 2:
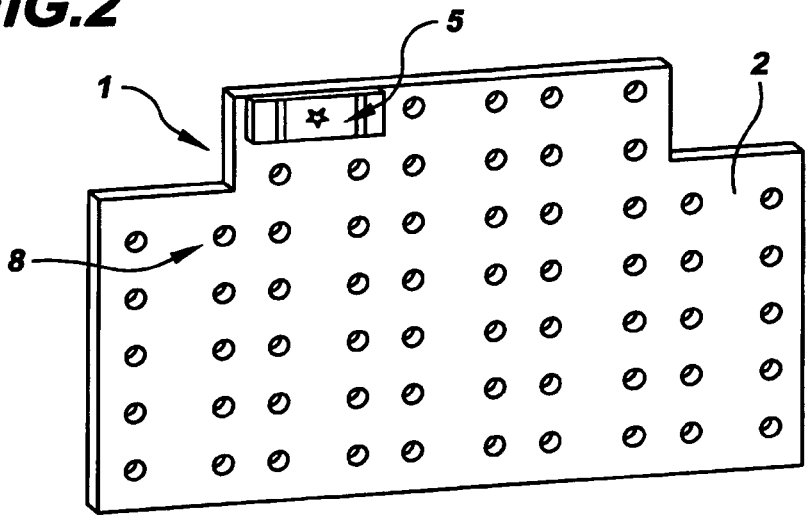
FIG. 2 is a perspective, front view of a blank according to the present invention.
Figure 3:
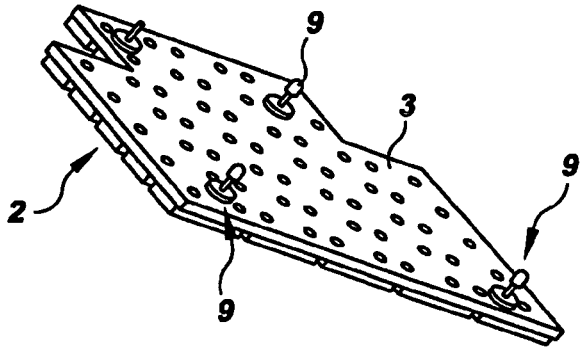
FIG. 3 is a rear perspective view of the blank according to the present invention.
Figure 4:
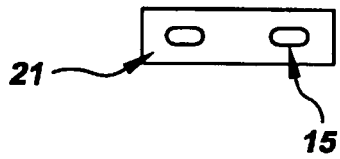
FIG. 4 is rear view of the base panel according to a second embodiment of the present invention.
Figure 5:
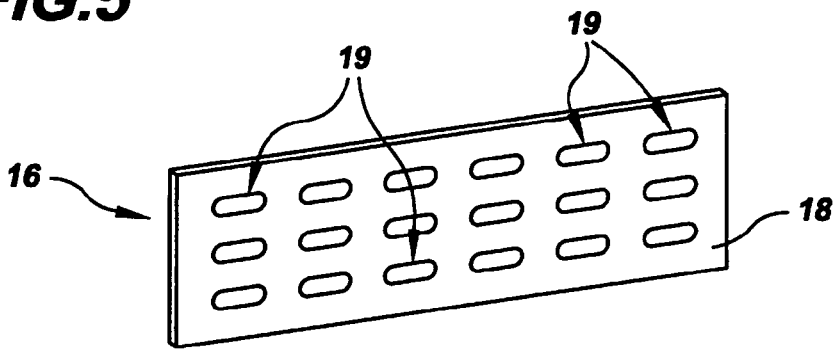
FIG. 5 is a front view of a blank sheet according to a second embodiment of the present invention.
Figure 6:
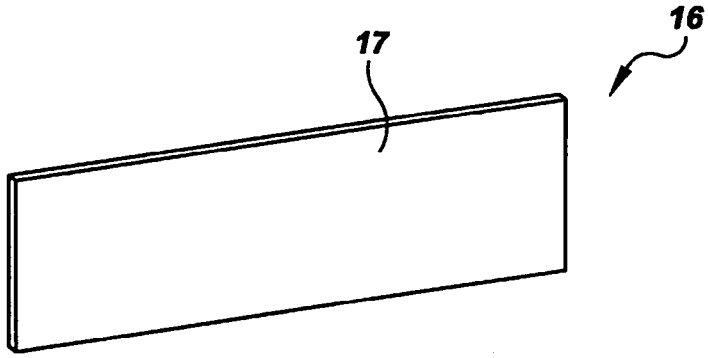
FIG. 6 is a rear view of the blank sheet according to a second embodiment of the present invention.
Figure 7:
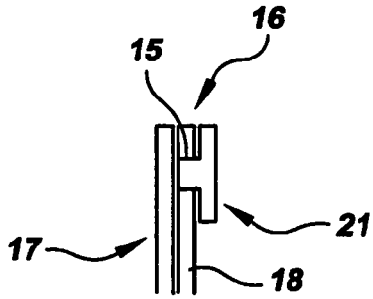
FIG. 7 is a side, cross-sectional view of the base panel secured to the blank sheet according to the second embodiment present invention.

The present invention relates to a military flat ribbon assembly. The embodiment depicted in FIGS. 1–3 comprises a plurality of ribbons each including a base plate 5 with at least one peg 6 extending from a side thereof. Each ribbon is unique and corresponds to a particular military achievement.

The assembly also includes a blank sheet 1 formed of plastic or a similar material having a front 2 surface and a rear surface 3. The sheet includes a plurality of apertures 8 each sized and positioned to the receive pegs extending from any one of the ribbon base panels. The rear surface of the sheet includes a plurality of fastening pins 9 thereon for fastening the sheet to the military uniform.

Accordingly, as a particular ribbon is earned, a corresponding base panel is retrieved or purchased. Flat ribbons are secured to the blank and are then fastened to a military uniform using the fastening pins. As additional ribbons are earned, they along with the existing ribbons are secured to another, larger blank which is fastened to the uniform as described above.

Now referring specifically to FIGS. 4–7, a second embodiment includes the peg 15 on the rear surface of the base panel 21 being magnetized for magnetically securing the base panel to a blank sheet 16. The sheet includes a rear, ferrous layer 17 and front layer 18 constructed with laminated acrylic or a similar material. The front layer includes a plurality of apertures 19 for receiving the magnets on the base panel. The apertures not only expose the ferrous surface to the magnets but serve as guide holes to keep the ribbon base panels aligned and somewhat stationary.

Accordingly, as a particular ribbon is earned, a corresponding base panel is retrieved or purchased. Flat ribbons are magnetically secured to the blank and are then fastened to a military uniform using fastening pins or similar means. As additional ribbons are earned, they along with the existing ribbons are secured to another, larger blank which is fastened to the uniform as described above.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A military flat ribbon assembly comprising:

at least one ribbon including a base plate with at least one peg extending from a side thereof, wherein said peg is magnetized;

a blank sheet having a rear layer and a front layer, said front layer sheet having a plurality of apertures thereon, each of said apertures sized and positioned to receive the peg, said rear layer constructed with a ferrous material to which said peg will magnetically adhere;

a fastening means on the rear surface of said sheet for fastening the sheet to a military uniform.

* * * * *